United States Patent [19]

Netz et al.

[11] Patent Number: 5,034,767

[45] Date of Patent: Jul. 23, 1991

[54] DEVELOPMENT SYSTEM

[75] Inventors: Yoel Netz, Bat Yam; Arnold Hoffman, Rehovot, both of Israel

[73] Assignee: Hanetz International Inc., Los Angeles, Calif.

[21] Appl. No.: 236,841

[22] Filed: Aug. 26, 1988

[30] Foreign Application Priority Data

Aug. 28, 1987 [IL] Israel ..... 83676

[51] Int. Cl.[5] ..... G03D 5/00

[52] U.S. Cl. ..... 354/317; 354/319; 354/324

[58] Field of Search ..... 354/317, 319, 324, 325

[56] References Cited

U.S. PATENT DOCUMENTS

| | | | |
|---|---|---|---|
| 2,404,138 | 7/1946 | Mayer | 354/325 |
| 2,555,874 | 6/1951 | Coughlin | 354/317 |
| 3,589,261 | 6/1971 | Krikelis | 354/325 |
| 3,680,462 | 8/1972 | Cronig | 354/317 |
| 3,981,583 | 9/1976 | Tsuchida et al. | 354/325 |
| 4,327,987 | 5/1982 | Friar et al. | 354/317 |
| 4,733,260 | 3/1988 | Kubo et al. | 354/317 |
| 4,737,810 | 4/1988 | Kobayashi et al. | 354/317 |

*Primary Examiner*—A. A. Mathews

*Attorney, Agent, or Firm*—Browdy and Neimark

[57] ABSTRACT

A system for the development of exposed silver-halide films where the film moves emulsion-up on conveyor means, a viscous developer being applied to said film from a mechanism located above the moving film close to one end of the conveyor means, means being provided adjacent the other end to remove excess developer, means being provided for rinsing and fixing the developed film. The developer may be applied via a narrow slit at the bottom of a container, where the slit is essentially perpendicular to the direction of movement of the film. The uniformity of development layer may be attained by a roof-section above the moving film, the space being filled with developer.

12 Claims, 3 Drawing Sheets

DEVELOPMENT SYSTEM

FIELD OF THE INVENTION

The invention relates to a novel system for the development of photographic silver-halide films. It provides means for applying a coating of predetermined thickness of a viscous developer/activator composition to a film moving emulsion-side up on a conveyor belt, as this passes beneath a feeder mechanism located above the moving film. The construction provides an essentially uniform developer layer, excess of developer being removed at the end of said conveyor belt by suitable squeezer means and returned to developer container. The film is rinsed, fixed and dried after the termination of the development stage.

BACKGROUND OF THE INVENTION

There exists a plurality of methods for the application of a coating of a viscous homogeneous layer to a substrate. The main methods are based on dipping, use of a roller mechanism spraying or the like. In some of the cases excess has to be removed: the removal by means of a squeezer system also increases the homogeneity of the layer. The material is generally in a fluid state and is converted to a "frozen solid" after application. When coating of the order of 0.01 mm or less is required, there must be adhered to very stringent controls of each feature of the coating step: such coatings are generally applied in special coating facilities.

Coatings such as adhesives are applied by means of a solid applicator which is coated with a viscous material, which applicator is contacted with the substrate. Such means cannot be used with film emulsions which ought hot to be touched by anything but the developer.

Polaroid-type film development systems provide a package of a predetermined quantity of development agent for use with each individual film and means for evenly spreading this on such film. The Polaroid system is expensive due to the separate containers for each development dosage for individual films and this system is not flexible as the developer quantity is intended for a given film size only. This system cannot be used for large film sizes.

SUMMARY OF THE INVENTION

According to the present invention there is provided a film development system which provides means for the application of an essentially homogeneous viscous developer to the film surface, as this moves emulsion-side up on a conveyor band beneath slit-formed application means, the slit being at a right angle to the direction of movement of the film. After moving at a predetermined speed on said conveyor, the time being adequate for completion of development of the film, excess of developer is removed by mechanical means, the film is rinsed, fixed and dried.

The application means of the viscous developer comprise a feeding system located above the conveyor belt, said system comprising a trough-shaped component provided with a slit-shaped opening into, optionally, a "reservoir" at its lower end, means being provided for feeding viscous developer to said through so that the rate of supply and rate of exit through the slit onto the moving film will be essentially identical, means for adjusting the speed of movement of the film conveyor and/or of the slit width so that a predetermined quantity of developer will be applied to the film per unit area.

According to a preferred embodiment of the invention the trough section is arranged above a slit-formed entrance above the conveyor, there being arranged adjacent to and extending from said slit, two sections parallel with said conveyor, and extending above the conveyor at a predetermined distance therefrom, extend for a predetermined distance on both sides of the slit. According to yet another embodiment of the invention, there is provided a roof-section adjacent said slit, at a given height above the moving film and two parallel roof sections extending therefrom in both directions, said parallel sections being at a smaller distance respective the film forming a reservoir.

The viscous developer is supplied from a reservoir means being provided for returning excess of the developer to said reservoir if so desired.

The rate of feed of the developer is such that the space between the bottom of roof, film on moving conveyor and adjacent ends of the roof-sections will be filled all the time with developer.

According to preferred embodiment means are provided along the conveyor for the prevention of developer losses from the edges of the film.

There exists certain quite critical parameters of the system; the rate of feed.

The "roof" of the sections adjacent the slit must not be too close to the film, as turbulences are apt to be set up. If, on the other hand, the "roof" is too far away, there will not be an even spread of the developer on the film. The slit width and length are such that there will always be an adequate quantity of developer therein to fill it well above the slit for various rates of feed. The invention will be illustrated by way of example only with reference to the enclosed schematical drawings, which are not according to scale, and in which:

FIG. 1, is a side-view of part of the device, illustrating the feeding means of developer to the section adjacent the slit;

FIG. 1*b*, illustrating another version of the slit;

DESCRIPTION OF THE INVENTION

Figure 1:
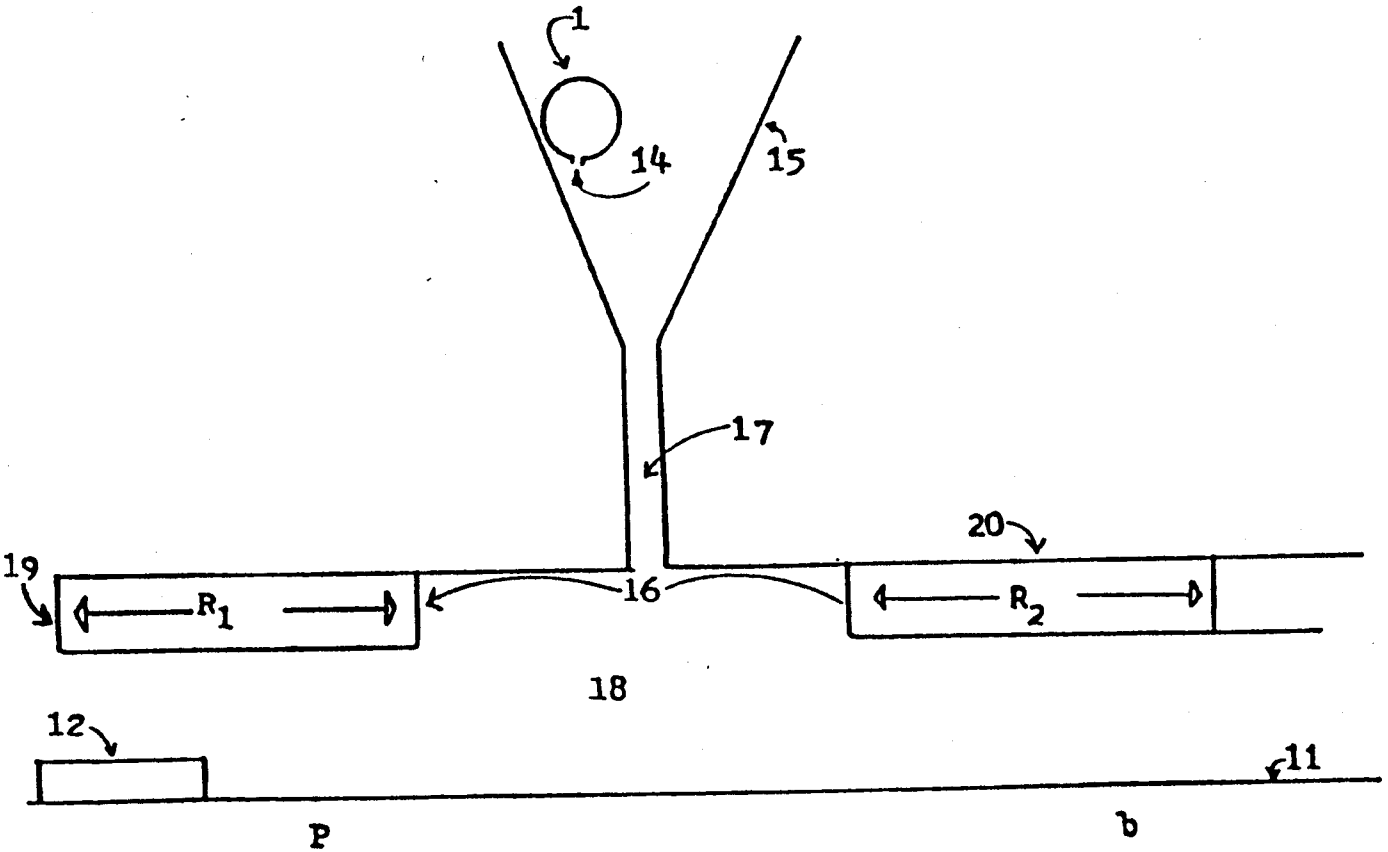

As illustrated with reference to FIG. 1, the device of the invention comprises a conveyor belt 11, which is generally wetted and to which there is thus applied film 12, which moves with the belt 11 from left to right. The aim of the device is to apply to the film an even layer of viscous developer agent, of the order of 1 mm thickness. Such developer is supplied from a container to feeding means 13, such as a conduit provided with the plurality of openings 14, positioned so as to have its longitudinal axis parallel with that of the trough-shaped section 15 of the container. Said trough defines an opening 16 in the form of a uniform slit of about 0.4 mm width; the height 17 being about 4 mm, the width of section 18 being about 6 mm, the distance between roof sections 19 and 20 and the conveyor belt 11 being of the order of 2–4 mm. According to one preferred embodiment the length of roof section 19 is about 20 mm and that of roof section 20 is about 50 mm. It can also extend along the full length of the conveyor. The conveyor belt speed is adjustable. For a belt of overall length of 120 cm from the point beneath the slit 16 to the right-hand end of the conveyor is about 50 cm.

For a belt width of 20 cm. a belt speed of 80 cm/minute with a supply of a developer at a viscosity of 180 cps at an even rate of 250 ml per minute resulted in an even layer of the developer on the film, of a thickness of about 1.5–2 mm.

The excess of developer is returned to the container and used for the development of further films.

Figure 2:
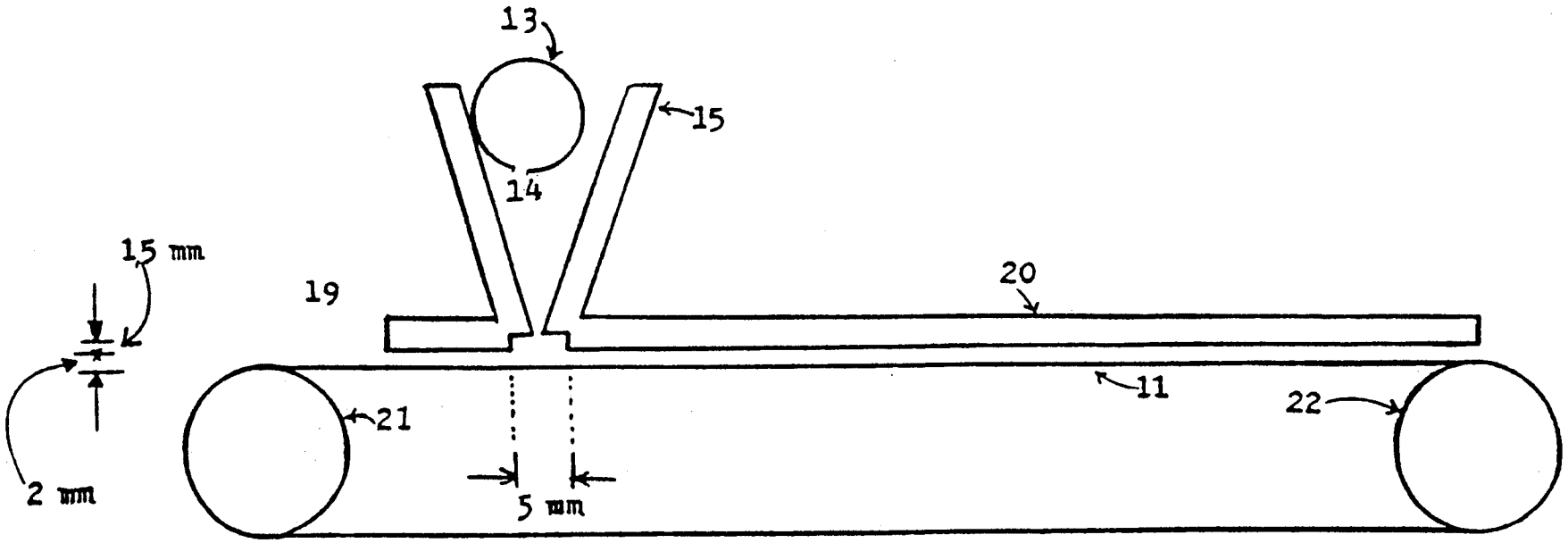
FIG. 2, is a schematical sectional side-view of the feeding and conveyor system.

As shown in FIG. 2, the belt 11 moves over rollers 21 and 22, the roof section 20 extending here to the end of the conveyor band 11.

Figure 3:
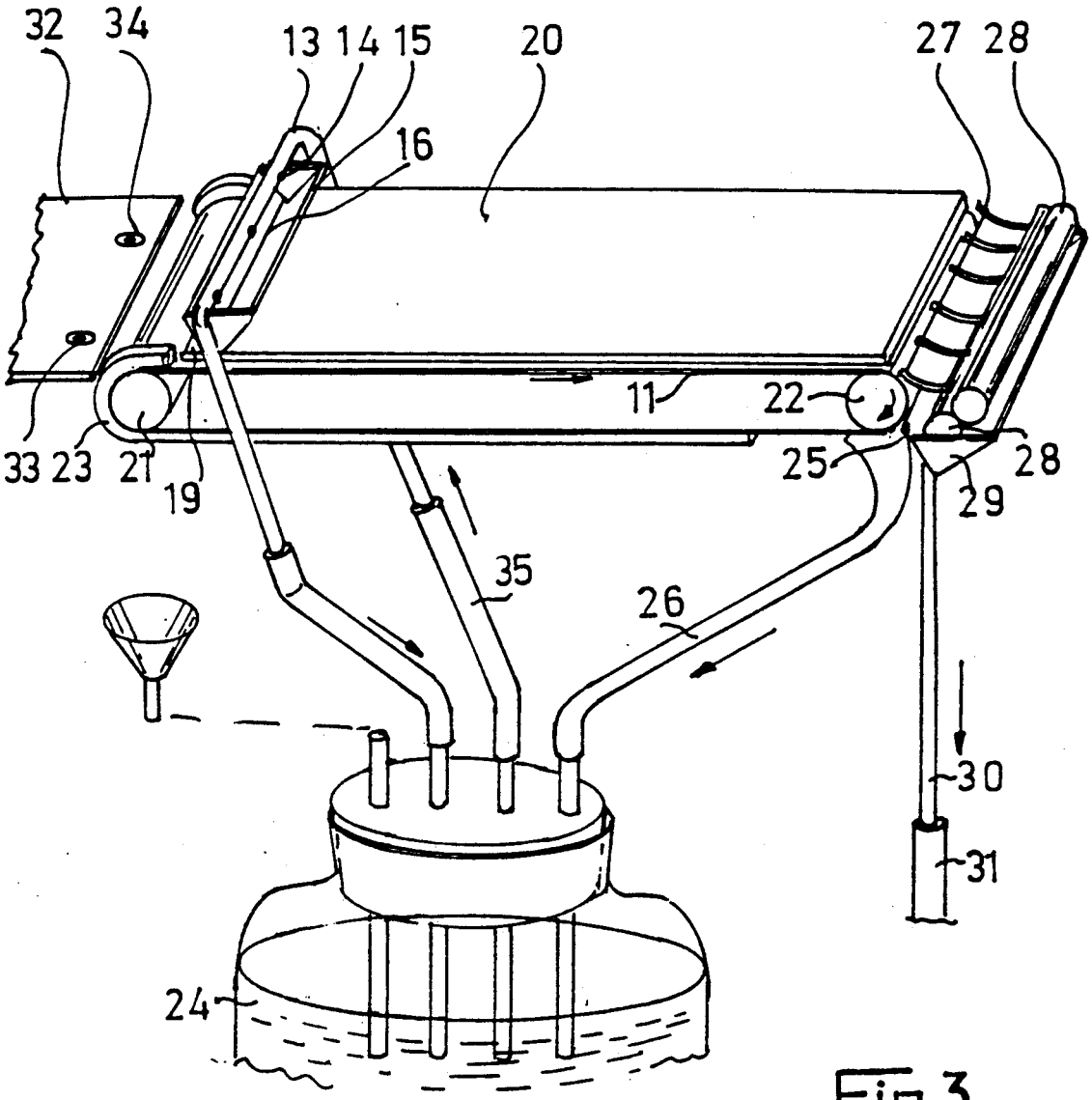
FIG. 3, is a schematical perspective view of the system of the invention.

An overall view of a system of the invention is shown in FIG. 3, where 11 is the conveyor band, 21 and 22 are the rollers over which this moves, there being provided a further band 23 extending to a given level above the conveyor 11, which prevents dripping off of the excess of the developer from the sides of the band 11. The development agent is contained in main developer container 24, from which there extends a conduit 35, which supplies the viscous developer to the feed line 13, located above the trough section 15 of the container, there being provided roof sections 19 and 20 extending from the slit at the bottom of trough 15. At the right-hand end of the conveyor 11 there is provided a blade 25, which collects unused developer which is returned via a conduit 26 to the container 24. The film leaves the conveyor 11 via guides 27 passing between squeege rollers 28, and moves on to the rinsing, fixing and drying stages.

Used developer squeeged off the film passes via exit 29 via conduit 30 to waste receiver 31.

The film is initially placed on the platform 32, the conveyor 11 being actuated when the film passes sensors 33 and 34.

It is to be noted that when the developer is applied to the film and to the conveyor band, some of it will be on the band adjacent and inbetween consecutive films. This quantity of the developer will not be used and means are provided for re-circulating it to the reservoir.

Furthermore, as the film passes on through the squeege rollers at the end of the conveyor, the band turns downwards, and the used developer is removed from the film surface and discarded.

It is advantageous to provide a circulation system from the developer/activator container, through the conduit and back to the container. This makes it possible to attain a better temperature control of the developer and to maintain it at an essentially constant temperature.

The height of the roof over the moving belt can be varied at will. A developer layer of about 0.3 mm thickness seems to be a required minimum. In experimental devices roof heights of between 1 and 4 mm were used and proved satisfactory. As evident from the above, the rate of feed from the container above the film to the film surface ought to be such as to provide a slight excess over the quantity required to fill the space between film on the conveyor and the roof above it. This excess provides for some "backflow" of the viscous developer, ensuring complete cover of the film surface by such developer.

It is possible to provide above the hopper section a water supply for rinsing the equipment after use or during change-over from one developer to another.

It is further advantageous to provide a rinsing system above the squeege roller system at the end of the conveyor. This can be used for rinsing off spent developer from the squeege rollers, and to direct the thus obtained solution to discard means. Rinse fluid can be water or acidified water.

Alternatively, rather than using a conveyor band, the film remains stationary, and the part of the device above the conveyor band, i.e., the means containing the container arranged above the conveyor, moves from one end of the film to the other, applying the developer onto the stationary film as it passes above the stationary film.

Alternatively, it is possible to provide more than one main container containing a variety of different developers, thus providing means for developing more than one type of film, with means for a rinse cycle between the use of different developers and/or activators.

In another embodiment of the present invention, rather than providing a moving conveyor band, the conveyor is stationary and the container is located above said film, whereby the conveyor moves from one end of the (stationary) film to the other, thereby applying the developer to the film.

An exposed film was placed with its emulsion facing upwards on a stationary flat support. About 200 ml of a viscous developer/activator was introduced into the hopper of a device as illustrated, but with the difference that the roof section and the hopper moved at a predetermined rate of travel over the length of the film. After a development time of about 60 seconds the developer was removed by means of a moving blade, the film was stopped, fixed, rinsed and dried. An even development was obtained.

We claim:

1. A device for the development of photographic films which comprises in combination an essentially horizontal conveyor on which the film is placed, emulsion-side up, during development, means for supplying a viscous developer to a container arranged above said conveyor, said container being provided with an exit slit for the application of such developer at a pre-determined rate to said conveyor and film positioned thereon, there being provided two roof sections adjacent said slit above the conveyor, means for actuating the conveyor at a pre-determined velocity; and means for removing the spent viscous developer from the film surface at a location where it leaves the end of the conveyor.

2. A device according to claim 1 where said slit is at a direction essentially perpendicular to the direction of movement of the conveyor belt.

3. A device according to claim 1, where means are provided for supplying the viscous developer at a rate which slightly exceeds the quantity required to fill the space between the film and the roof above it.

4. A device according to claim 1, where the roof sections above the conveyor extend beyond the conveyor in both directions parallel to the direction of movement of the conveyor.

5. A device according to claim 2, where the roof section extending from the slit in the direction of movement of the conveyor extends for the entire length, or greater part of the length of the band in that direction.

6. A developing device according to claim 1, where rinsing means are provided at any required location of the system.

7. A device according to claim 1, where a squeege roller system is provided at the end of the conveyor for removing the excess of spent developer from the film.

8. A device according to claim 1, where means are provided for removing unused developer from the conveyor belt at the end of the conveyor belt in the direction of travel of the film and returning it to a main developer container.

9. A device according to claim 1, where sensor means are provided for actuating the application of the viscous developer sometime before the film reaches the application slit.

10. A device according to claim 2 wherein circulation means are provided between a main developer container and the container above the belt and back again to said main developer container.

11. A device according to claim 1 wherein more than one main developer container is provided, each of said main developer container containing different developers, thus providing means for the development of more than one type of film, with means for a rinse cycle between the use of different developers.

12. A device according to claim 1 wherein said container is stationary and said container is located above said film, whereby a moving conveyor band moves from one end of the film to the other, thereby applying the developer to the film.

* * * * *